US005816825A

United States Patent [19]

Sekimori et al.

[11] Patent Number: 5,816,825

[45] Date of Patent: Oct. 6, 1998

[54] CONNECTOR UNIT PROVIDED WITH MAGNETICALLY LOCKING MECHANISM

[76] Inventors: Toshiyuki Sekimori, 2-18, Takami-cho, Toyota-shi, Aichi, 473, Japan; Yasuyoshi Fukao, 150-5, Minamidaira, Josui-cho, Toyoto-shi, Aichi, 470-03, Japan; Shigeo Mori; Shigemi Hashizawa, both of c/o Yazaki Parts Co., Ltd., 206-1, Nunobikibara, Haibaracho, Haibara-gun, Shizuoka, 421-04, Japan

[21] Appl. No.: 757,269

[22] Filed: Nov. 27, 1996

[30] Foreign Application Priority Data

Nov. 29, 1995 [JP] Japan ..... 7-310706

[51] Int. Cl.[6] ..... H01R 11/30

[52] U.S. Cl. ..... 439/39

[58] Field of Search ..... 439/38, 39, 40, 439/289

[56] References Cited

U.S. PATENT DOCUMENTS 3,521,216 7/1970 Tolegian ..... 439/39

5,385,476 1/1995 Jasper ..... 439/38

5,401,175 3/1995 Guimond et al. ..... 439/39

*Primary Examiner*—Hien Vu

*Attorney, Agent, or Firm*—Armstrong, Westerman, Hattori, McLeland & Naughton

[57] ABSTRACT

A first connector of a pair of connectors fitted has a shell accommodating a second connector of the connectors. By fitting both connectors, female terminals and male terminals are connected to each other. The second connector includes an outer case removably inserted in the shell, an inner case incorporated in the outer case and inserting female terminals therein, a cylindrical body accommodated rotatably in the outer case, and a locking member with an operating lever formed on the cylindrical body. An abutting-on portion in the cylindrical body on the side of the shell has a first magnetic substance. Another abutting-on portion in the shell on the side of the cylindrical body has a second magnetic substance having a polarity opposite to that of the first magnetic substance.

12 Claims, 9 Drawing Sheets

CONNECTOR UNIT PROVIDED WITH MAGNETICALLY LOCKING MECHANISM

BACKGROUND OF THE INVENTION

1. Field of the Invention

The present invention relates to a connector unit provided with a magnetically locking mechanism in which a female connector and a male connector are locked to each other by means of a magnet.

2. Description of the Prior Art

FIG. 14 shows a conventional locking arrangement for a connector unit. Reference numeral 71 is a connecting body constituting a connector, and reference numeral 75 is a mounting portion of an electric appliance, such as an electrically water-heating machine. The connecting body 71 includes electrically conductive coil springs 72 having first ends which are fixed, lead wires 73 of a cord extending from a power supply and connected to the first ends of the coil springs 72, and a magnet 74. The connecting body 71 and the mounting portion 75 are attracted to each other, and then locked by the gravitational force of the magnet 74. The second ends of each of the coil springs 72 and a tip end of each of connecting pins 76 abut each other, and then are electrically connected to each other.

As shown in FIG. 14, because of the small size of the connecting body 71, a large force is not required to hold the connecting body 71 and so the connecting body 71 can be disconnected by a small force. But if the connecting body 71 is large in size, a relatively large force is required to hold the connecting body 71. Correspondingly, a large disconnecting force is required to disconnect the connecting body 71. Because the fitting and the disconnecting operations require a large force, the fitting and disconnecting operations are difficult operations.

In FIG. 14, the connecting body 71 which is attracted to and held in the mounting portion. If an end portion of the connecting body 71 on the side of the lead wires 73, is pressed up or down while the connecting body 71 is being released from the mounting portion 75 it is possible to relatively weaken the pressed force by means of the principle of a lever. But, as each of the coil springs 72, serving as a connecting terminal, directly receives the pressed force slant at an angle from an end face of each of connecting pins 76, the connecting terminal is bent and damaged. This is a drawback of the prior art connector unit locking arrangement.

SUMMARY OF THE INVENTION

An object of the present invention is to provide a connector with a magnetically locking mechanism which, in the case of using a strong magnet as the locking mechanism for a relatively large-type connector, can be disconnected with weak strength, and to provide the connector so that it is easy to do a disconnecting operation, wherein the connecting terminal is not damaged during the disconnecting operation.

A connector unit, provided with a magnetically locking mechanism, includes a first connector; a second connector having a shell for accommodating the first connector; a pair of terminals connected electrically to each other by fitting the first connector into the second connector; the first connector having an outer case inserted removably into the shell, an inner case incorporated in the outer case and inserting a first terminal of the terminals inside, a cylindrical body rotatably accommodating the outer case, and a locking member having an operating lever for the cylindrical body; a first abutting-on portion in the cylindrical body on the side of the shell having a first magnetic substance; and a second abutting-on portion in the shell on the side of the cylindrical body having a second magnetic substance having a polarity to that of the first magnetic substance.

According to the present invention, because locking a first connector and a second connector magnetically attracts a locking member of the first connector to a shell of the second connector, it is possible to detach the locking member from the shell with a relatively weak force by means of an operating lever according to the principle of a lever, and it is easy to disconnect the locking member and the shell.

Referring to the Figures, such a feature of the present invention will be described below. In FIG. 1 through FIG. 3, a lever 4, which has a first magnetic substance 3, is mounted in a male connector 1. A second magnetic substance 3', with a polarity opposite to that of the first magnetic substance 3, is arranged at a shell 2*a* in a female connector 2. As both connectors 1 and 2 approach to each other, both magnetic substances 3 and 3' affect each other, and both connectors 1 and 2 are attracted to each other with gravitational force and are fitted to each other (see FIG. 2). While disconnecting both connectors 1 and 2, as the lever 4 rotates around a supporting point O in a direction P, the first magnetic substance 3, on a front face of the lever 4, is detached from a bottom side of the male connector 1. Therefore, it is possible to disconnect both connectors 1 and 2 by means of a relatively weak force (see FIG. 3).

According to the invention, because, for example, an inner case, having male or female terminals, is accommodated so that the inner case can move from and to an outer case, before the fitting operation of a first and a second connector by means of locating the inner case inside the outer case, and advancing the inner connector at the time of the fitting operation, the fitting operation can be done securely without accidents, such as short-circuiting and electric shock.

In addition, according to the invention, because a locking arm, which is engaged with the outer case, is arranged in the inner case, so long as the locking arm is released, the inner case does not fit completely in the shell in the second connector, and it is possible to regulate the fitting operation.

The above and after other objects and features of the present invention will be more apparent from the accompanying drawings.

DESCRIPTION OF THE PREFERRED EMBODIMENTS

Referring to the Figures, a first preferred embodiment of the present invention will be described below.

In FIG. 4 through FIG. 8, alphabetic character A denotes a feeder-side connector which is used in ordinary houses, various offices, and similar, and alphabetic character B denotes a receiver-side connector that is mounted in a car body.

Figure 10:
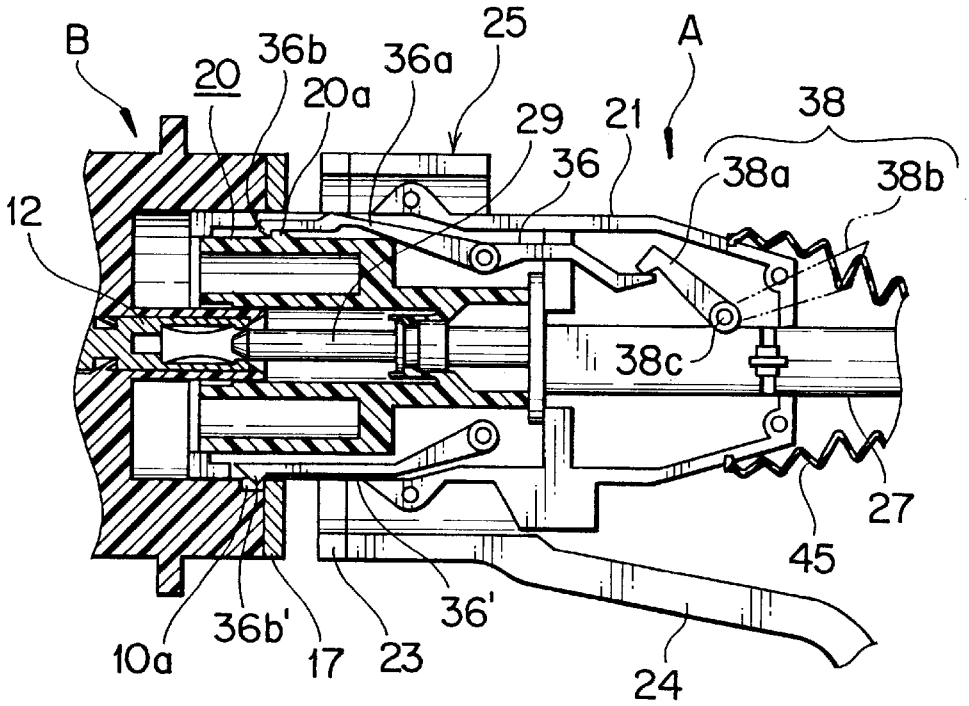
FIG. 10 is a longitudinal cross-sectional view of a preliminarily fitted state shown in FIG. 4.

The receiver-side connector B includes a shell 10 which receives the feeder-side connector A, plural terminal chambers which accommodate and engage female terminals 12 (see FIG. 10) inside the shell 10, and a flange 13 which is arranged on an outer surface of the shell 10. The receiver-side connector B is fixed in a car body (not shown) by means of the flange 13. A cap 14 is locked by a locking arm 15 in the state of closing the shell 10, unless using the receiver-side connector B. Numeral 16 denotes a cable which bundles lead wires connected to the female terminals 12. A first permanent magnet 17 is located on a front end portion of the shell 10. The first permanent magnet 17 possesses a magnetic polarity opposite to that of a second permanent magnet 23 which is arranged on a locking member 25 described below later. It is also possible to substitute a magnetic substance such as a steel ring for the first permanent magnet 17.

The feeder-side connector A includes an inner case 20, an outer case 21, which moves from and to the inner case 20, which incorporates the inner case 20, and which is fitted in the shell 10, the locking member 25, which advances and retreats, and which is rotatably located on an outer surface of the outer case 21, a connecting cable 26, and a protective tube 27 for guarding the connecting cable 26. The locking member 25 includes a cylindrical body 22, a second permanent magnet 23 arranged on a front end portion of the cylindrical body 22, and an operation lever 24 formed on a back end portion of the cylindrical body 22. The cylindrical body 22 and the inner case 20 are linked to each other so as to move from and to the outer case 21.

The inner case 20 is made of a synthetic resin which possesses a insulator, and has plural terminal chambers 28. Each of male terminals 29 is inserted in each of terminal chambers 28, and is secured to a pair of flexible locking arms 30 which are formed on each of the terminal chambers 28. Each of the lead wires 31, which is connected to each of the male terminals 29, is collected as one piece and is incorporated in the protective tube 27. A straight tube portion 27*a*, which is formed at a front half portion of the protective tube 27, is fixed in a back end of the inner case 20 passing through a mounting plate 32. Therefore, the inner case 20 and the protective tube 27 can move as a one-piece body from and to the outer case 21.

The outer case 21 includes a pair of half cases 21A and 21B, which are divided symmetrically, and bolt holes 33 (see FIG. 6) formed at both of an upper and a lower edge portion of each of a pair of half case 21A and 21B. By inserting bolts (not shown) into the bolt holes 33, the half case 21A and the half case 21B engage each other. The outer case 21 is divided into a front and a back half portion by a division wall 34 at which a passing hole 34*a* is formed. The inner case 20 is incorporated in the front half portion. The straight tube portion 27*a* of the protective tube 27 is accommodated in the back half portion. The straight tube 27*a* is slidably held in the passing hole 34*a* of the division wall 34 and an opening hole 35 which is formed at a back end of the inner case 20.

A pair of locking arms 36, 36' are located at the front half portion in the inner case 21 so as to oppose each other. A releasing lever 38 is formed at the back half portion of the inner case 21.

A first locking arm 36 that locks the inner case 20, is supported by a pin 37 at a middle portion thereof. A locking pawl 36*b*, like a hook, is formed at a tip end of a front arm portion 36*a* of the first locking arm 36. A back arm portion 36*c* extends to a back half portion of the outer case 21 through the division wall 34 of a slit (not shown). The locking pawl 36*b* of the front arm portion 36*a* engages a locking projection 20*a* formed on an outer surface of the inner case 20. The back arm portion 36*c* is formed so as to serve as an engaging lug for the releasing lever 38. The releasing lever 38 comprises an action lug 38*a* and an operating lug 38*b* which are formed so as to cross each other. A crossing portion is supported by a pin 38*c*. In a normal state, the action lug 38*a* contacts an upper face of the back arm portion 36*c* of the first locking arm 36. The operation lug 38*b* projects out from a bellows-shaped sealing cap 45 that is formed at the back end portion of the outer case 21.

The second locking arm 36' is engaged with the receiver-side connector B and then is preliminarily locked. A locking pawl 36*b*' is located at a tip end of the second locking arm 36'. A back end of the second locking arm 36' is supported by a pin 37'. The locking lug 36*b*' is formed in a so-called semi-lock type mountain shape.

A tip end portion of each of the locking arms 36 and 36' is exposed through each of windows 39 and 39' which are formed at the outer case 21 so as to be opposite to each other.

In addition, the outer case 21 has slide grooves 41 for advancing and retreating the locking member 25, and linking holes 43 for linking the inner case 20 and the locking member 25.

Figure 8:
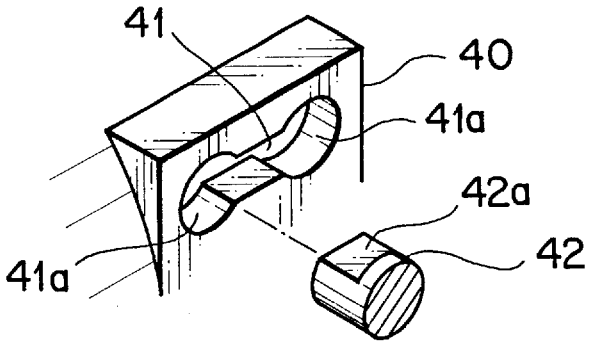
FIG. 8 is a perspective view of a slide pin and a slide groove shown in FIG. 1.

That is, bosses 40 are projected on an outer surface of a half front portion of each of the half cases 21A and 21B (see FIG. 8). Each of the bosses 40 has a slide groove 41 which is located in an upper side portion of the half front portion in a transverse direction. Each of circular axis hole portions 41*a* is formed at both ends of the slide groove 41. Supporting axis 42 (described below) of the locking member 25 are slidably formed. Linking holes 43 are formed in a transverse direction at a middle portion of the outer surface of each of the half cases 21A and 21B. A half circular relief hole 43*a* (described below) is formed at a tip end of each of the linking holes 43, 43' in order to allow the locking member 25 to rotate.

A cylindrical body 22 of the locking member 25 is constituted by the same half cases as the outer case 21. The supporting axes 42 and the slide pins 44 are projected in each of the half cases. A key portion 42*a*, which is engaged with the slide groove 41, is formed in the tip end portion of each of the supporting axes 42. Each of the supporting axes 42 is arranged slidably and rotatably in each of the slide grooves 41. The slide pins 44 pass through the linking holes 43 in the outer case 21. A tip end of each of the slide pins 44 is inserted in a second linking hole 43' formed in the inner case 20. In addition, the second linking holes 43' is formed in the shape of a bow so that the inner case 20 does not get out of position during a rot&ting operation of the locking member 25 (described below).

Figure 9:
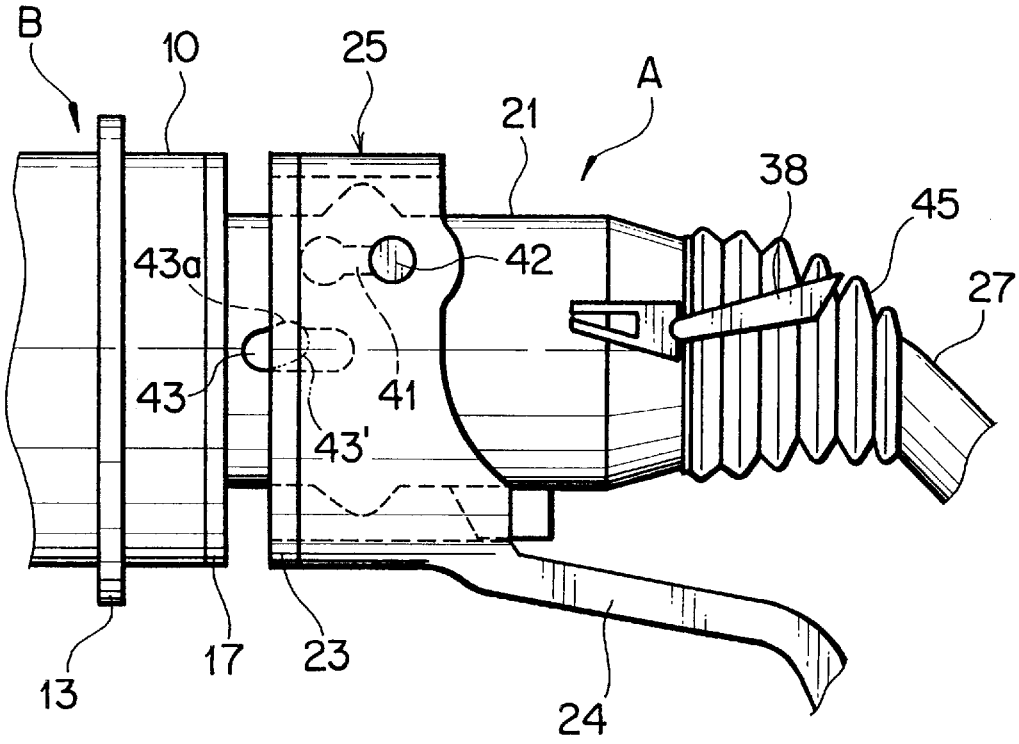
FIG. 9 is a side view showing the state where feeder-side and the receiver-side connector shown in FIG. 4 are preliminarily fitted.

In the structure mentioned above, as shown in FIGS. 9 and 10, the outer case 21 in the feeder-side connector A is fitted into the shell 10 in the receiver-side connector A. Because the locking pawl 36*b*' in the second locking arm 36' is engaged with the recess 10*a* which is formed at an inside surface of the shell 10, both connectors A and B are preliminarily locked to each other. As the locking projection 20*a* in the inner case 20 is engaged with and locks the locking pawl 36*b* in the locking arm 36 on the side of the outer case 21 at the preliminarily locked position, the outer case 21 does not go further inside the shell 10, and male terminals 29 and female terminals 12 are at either the state immediately before contact or at the state of starting contact.

Figure 11:
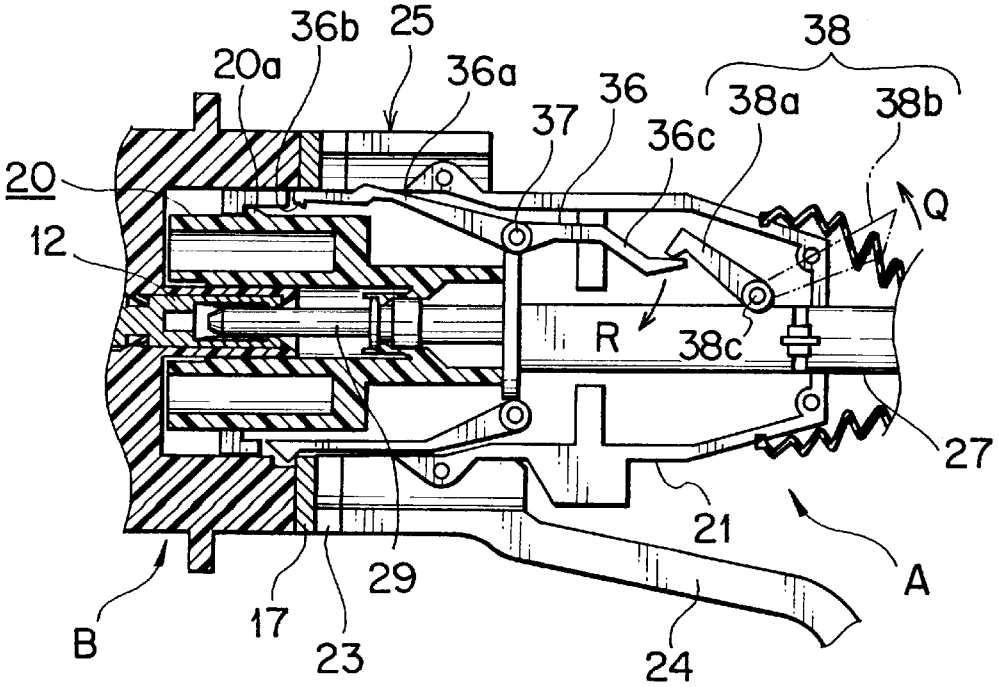
FIG. 11 is a longitudinal cross-sectional view of a fully fitted state shown in FIG. 4.

After the preliminarily locked state mentioned above, as shown in FIG. 11, if the operation lug 38*b* in the releasing lever 36 is rotated in the direction Q, because the action lug 38*a* push down the back arm portion 36*c* in the locking arm 36 in the direction R, the front arm portion 36*a* rotates upward, and the locking state between the inner case 20 and the locking arm 36 is released.

Accordingly, by a gravitational or repulsive force between the permanent magnet 23 of the locking portion 25 and the permanent magnet 17 which is located at the front end in the shell 10, or by additionally to pushing with one's hands according to the circumstances, the inner case 20 and the locking member 25 move in the direction of the receiver-side connector B, both connectors A and B are locked with the repulsive force between the first and the second permanent magnets 17, 23 respectively, and the male 29 and female terminals 12 are fully inserted into and connected to each other. Because the supporting axes 42 are guided into the slide grooves 41 and the slide pins 44 into the linking holes 42, the inner case 20 and the locking member 25 are able to move smoothly on the outer surface of the outer case 20.

Figure 1:
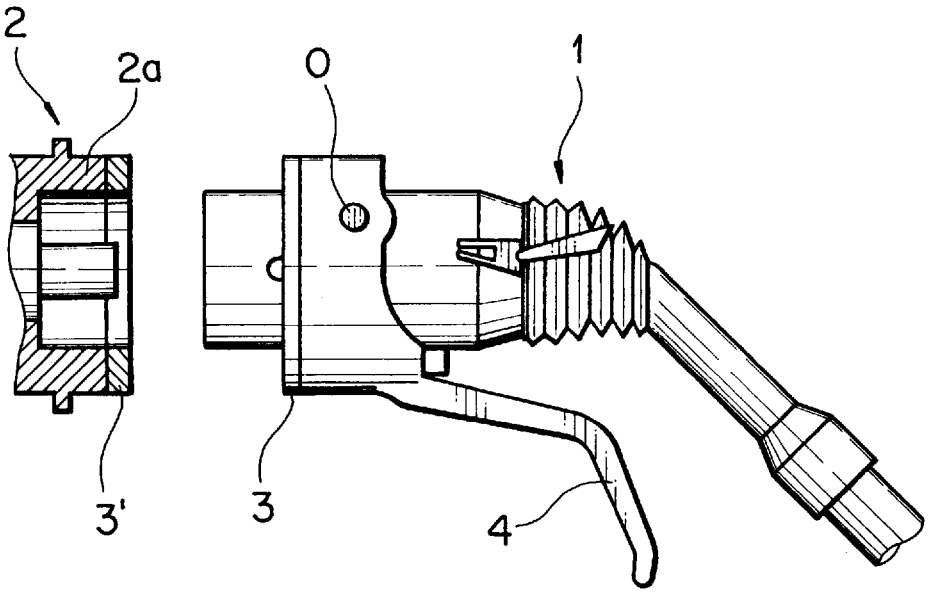
FIG. 1 is a side view showing the state where a female and a male connector are separated.
Figure 2:
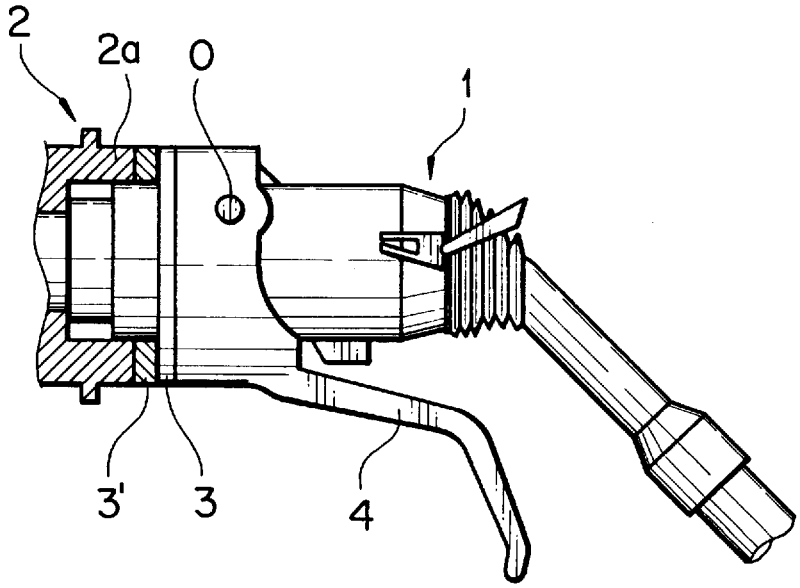
FIG. 2 is a view for explaining a fitted state shown in FIG. 1.
Figure 3:
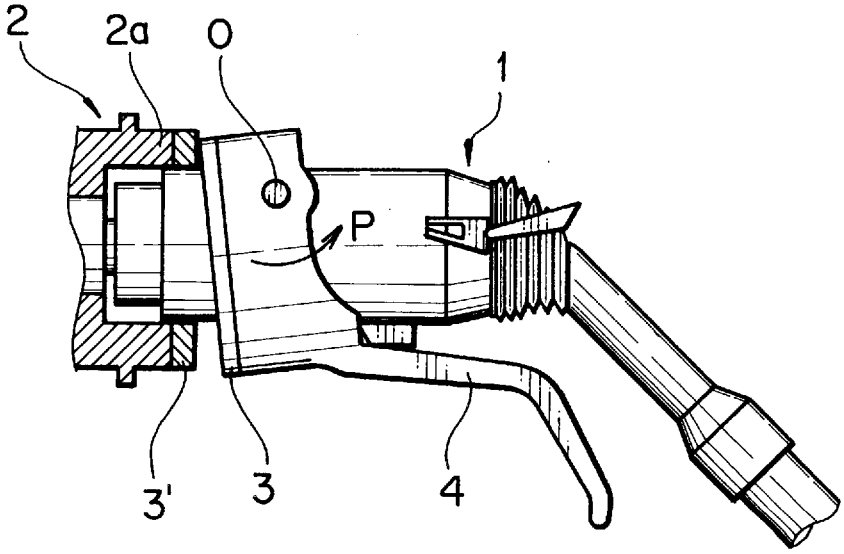
FIG. 3 is a view for explaining the releasing means shown in FIG. 2.
Figure 4:
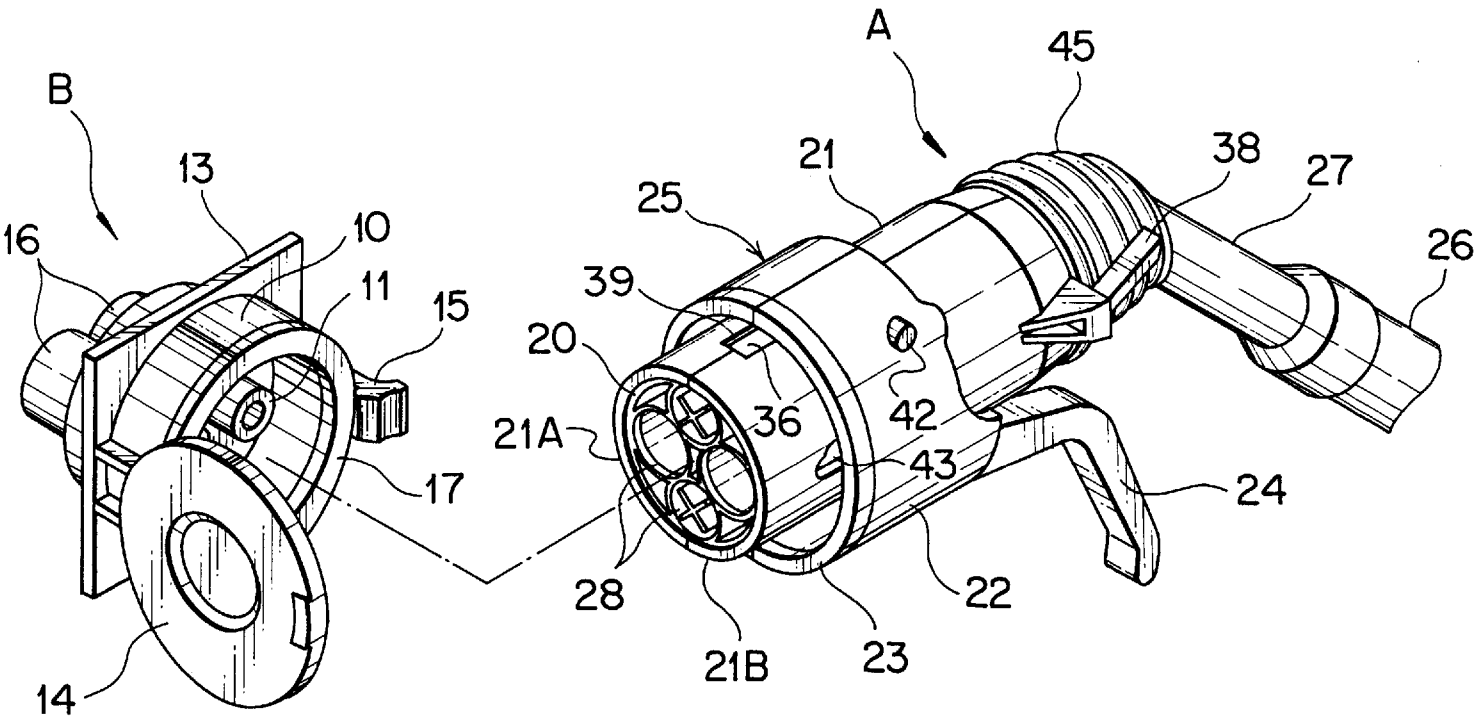
FIG. 4 is a perspective view showing a separated state of a feeder-side and a receiver-side connector of a first preferred embodiment of the present invention.
Figure 5:
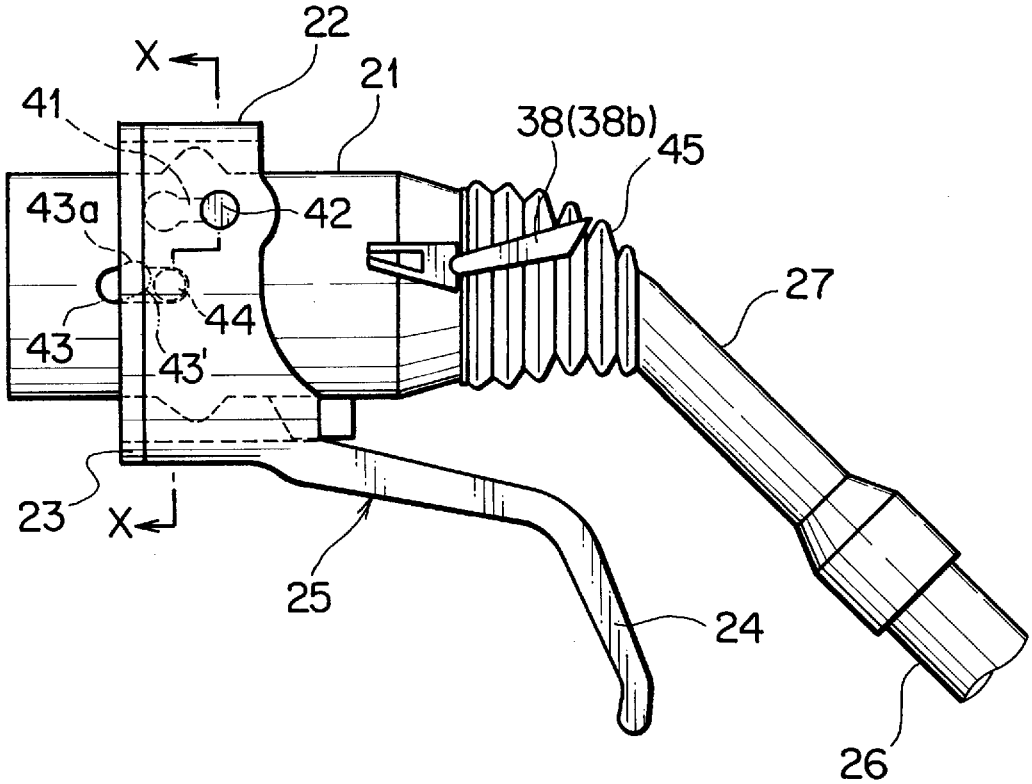
FIG. 5 is a side view of the receiver-side connector shown in FIG. 4.
Figure 6:
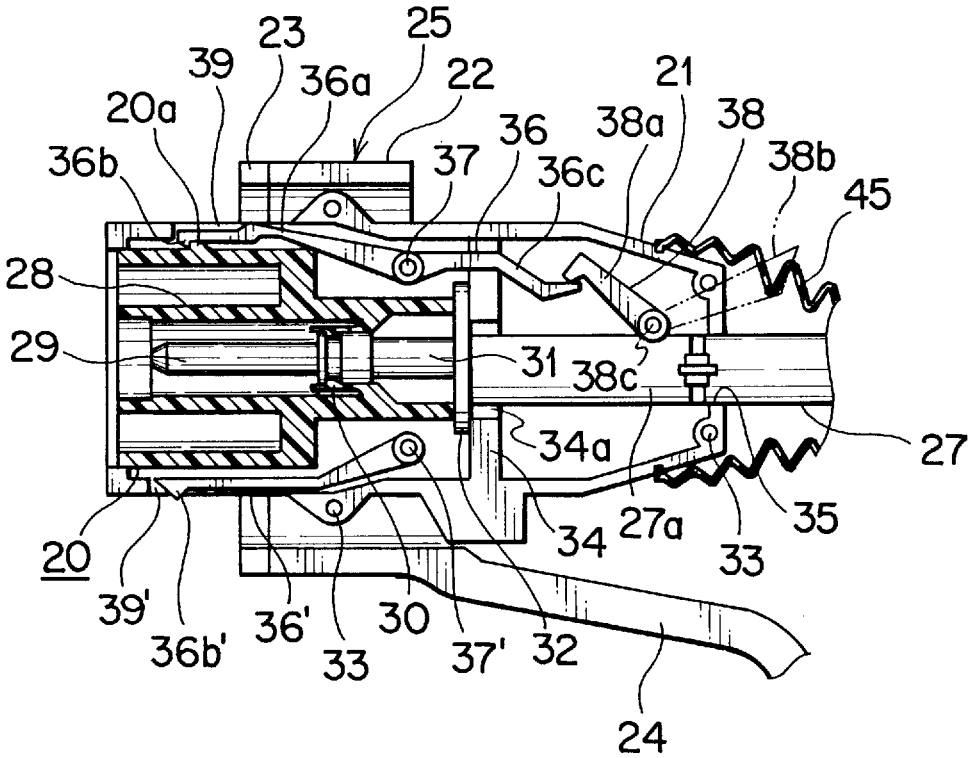
FIG. 6 is a longitudinal cross-sectional view of FIG. 5.
Figure 7:
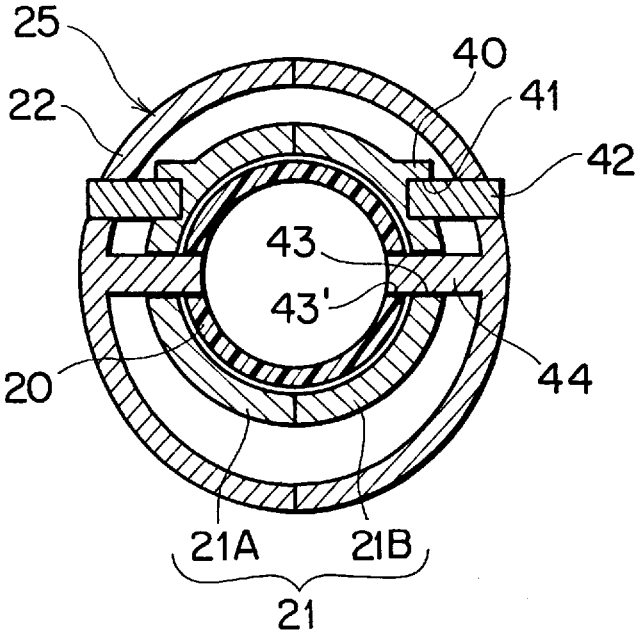
FIG. 7 is a cross-sectional view taken along line X—X of FIG. 5.

While releasing both connectors A and B, which are fitted, if the operating lever 24 is pulled in the same direct-ion as in the direction P shown in FIG. 3, the locking member 25 rotates around the supporting axes 42 according to the principle of the a lever. As a lower end portion of the second permanent magnet 23 is detached from the first permanent magnet 17, the locked state between between the first and the second permanent magnets 17, 23 is released by a relatively weak force. After having released the locked state, the outer case 21 is withdrawn from the receiver-side connector B.

After having released the locked state between the feeder-side A and receiver-side connector B, the operator lever 24 is rotated in the opposite direction of the direction P, and returns the state before being rotated. Then, as the locking member 25 is withdrawn in the backward direction of the outer case 21, the locking member 25 retreats according to the principle of a lever, and returns to the state shown in FIG. 9.

Figure 14:
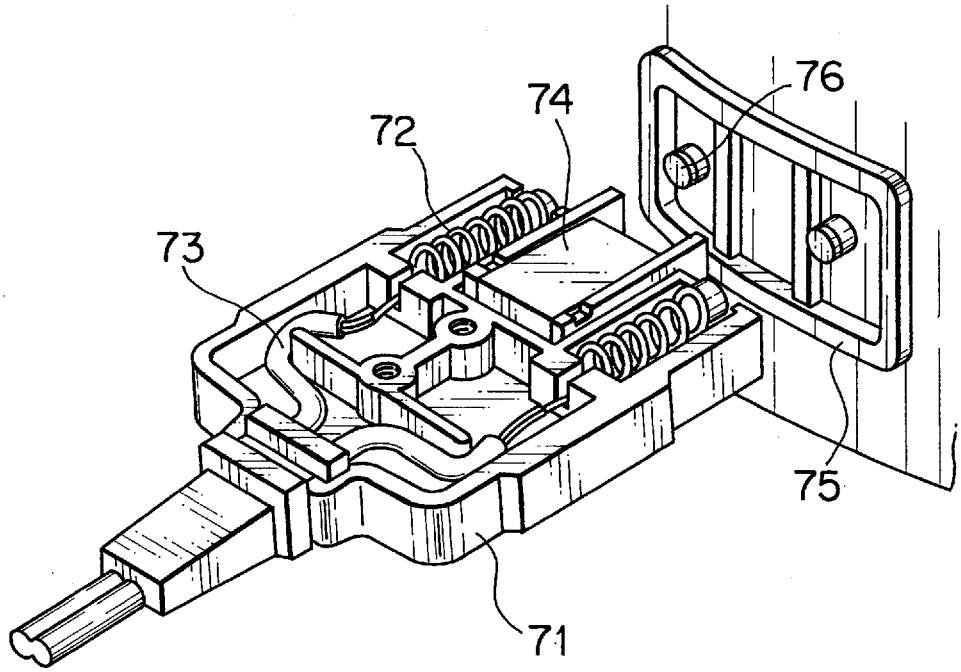
FIG. 14 PRIOR ART
FIG. 14 is a view for explaining a conventional locking technique for a connector.

The description above is directed to a case wherein the male terminals 29 are in the feeder-side connector A and the female terminals 12 are in the receiver-side connector A, but it is also possible insert male terminals 29 into the receiver-side connector B and female terminals 12 into the feeder-side connector A. Otherwise, instead of an inserting terminal type so as to insert the male terminals 29 into the female terminals 12, it is also possible to use an abutting-on type of terminal so as to abut the coil springs b on the linking pins f similar to the conventionally used arrangement shown in FIG. 14.

Figure 12:
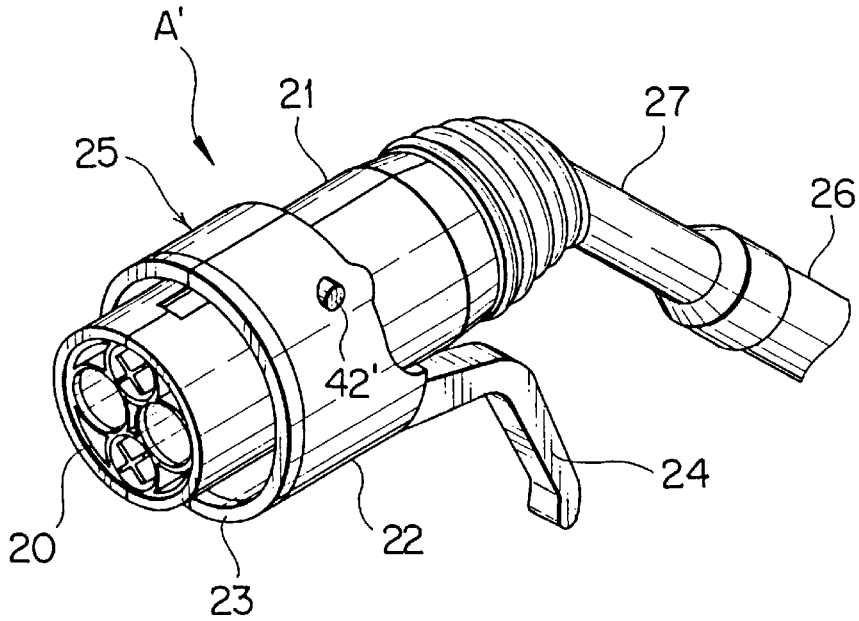
FIG. 12 is a perspective view showing a feeder-side connector which is a second preferred embodiment of the present invention.
Figure 13:
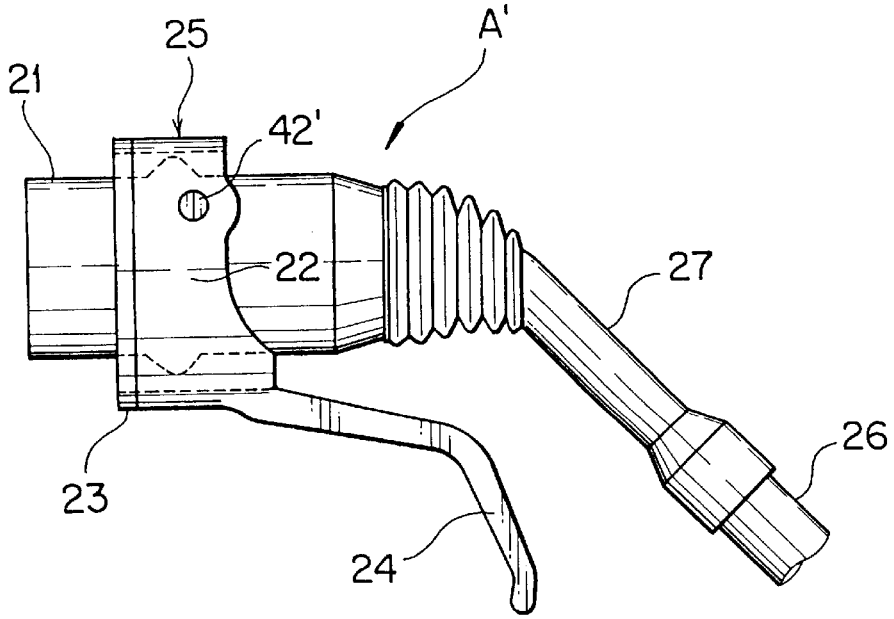
FIG. 13 is a side view of FIG. 12.

FIGS. 12 and 13 show a second preferred embodiment according to the present invention. That is, the feeder-side connector A' comprises the inner case 20, the locking member 25, and the outer case 21. The inner case 20 does not advance and retreat into the outer case 21. The locking member 25 is rotatably supported on the outer case 21 by pins 42'. In this case, it is proper that the locking member 25 is arranged at little more back to the rear of the outer case 21 than the locking member 25 shown in FIG. 4 to FIG. 11. It is possible to omit the locking arm 36, the releasing lever 38 and similar from the second embodiment.

The fitting operation of the feeder-side connector A' and the receiver-side connector B, and operation of the second permanent magnet 23 in the locking member 25 is the same as that of the first embodiment.

In the case of the releasing operation, if the outer case 21 is formed so as to be engaged with the shell 10 of the receiver-side connector B, when the locking member 25 is rotated as shown in FIG. 3 and the second permanent magnet 23 is detached from the first permanent magnet 17 in the feeder-side connector B, since the location of the outer case 21 does not get out of position, the feeder-side connector A can be withdrawn smoothly from the receiver-side connector B.

What is claimed is:

1. A connector unit provided with a magnetically locking mechanism comprising:

a first connector hiving an outer case, an inner case within said outer case, and at least one terminal located within said inner case;

a second connector having a shell for accommodating a front end portion of said first connector therewithin and at least one terminal located within said shell, wherein said at least one terminal of said first connector is electrically connected to said at least one terminal of said second connector when said front end portions of said first connector is removably fitted within said shell of said second connector;

a cylindrical body pivotally accommodating said outer case therewithin so that said cylindrical body pivots in a counter-clockwise direction and back again around an axis perpendicular to a longitudinal axis of said inner case and said outer case, wherein a first front end portion of said cylindrical body on an end of said cylindrical body which is opposite to said shell when said outer case of said first connector is housed within said shell of said second connector, said first front end portion of said cylindrical body being composed of a first magnetic substance and a second front end portion of said shell on an end of said shell which is opposite of said cylindrical body around said second connector, wherein said second front end portion of said shell is composed of a second magnetic substance having a polarity opposite to that of said first magnetic substance so that when said first front end portion of said first connector is housed within said shell of said second connector, said first magnetic substance attracts said second magnetic substance by a magnetically attractive force to form said magnetically locking mechanism for holding said first connector to said second connector;

a locking member having an operating lever connected to said cylindrical body, wherein said operating lever is depressed to pivot said cylindrical body in said counter-clockwise direction to easily disconnect said first connector from said second connector.

2. The connector unit provided with a magnetically locking mechanism as set forth in claim 1, wherein said first magnetic substance is a first permanent magnet.

3. The connector unit provided with a magnetically locking mechanism as set forth in claim 1, wherein said second magnetic substance is a second permanent magnet.

4. The connector unit provided with a magnetically locking mechanism as set forth in claim 1, wherein said second magnetic substance is a second permanent magnet and said second magnetic substance is a second permanent magnet.

5. A connector unit provided with a magnetically locking mechanism comprising:

a first connector having an outer case, an inner case within said outer case, and at least one terminal located within said inner case;

a second connector having a shell for accommodating a front end portion of said first connector therewithin and at least one terminal located within said shell, wherein said at lease one terminal of said first connector is electrically connected to said at least one terminal of said second connector when said front end portion of said first connector is removably fitted within said shell of said second connector;

a cylindrical body pivotally and movably surrounding said outer case therewithin so that said cylindrical body pivots in a counter-clockwise direction and back again around an axis perpendicular to a longitudinal axis of said inner case and said outer case;

a locking member having an operating lever connected to said cylindrical body, wherein said cylindrical body in said locking member and said inner case are connected to each other so that said cylindrical body and said inner case move to and from said outer case together, wherein a first front end portion of said cylindrical body on an end of said cylindrical body which is opposite to said shell when said outer case of said first connector is housed within said shell of said second connector, said first front end portion of said cylindrical body being composed of a first magnetic substance and a second front end portion of said shell on an end of said shell which is opposite of said cylindrical body around said second connector, wherein said second front end portion of said shell is composed of a second magnetic substance having a polarity opposite to that of said first magnetic substance so that when said first front end portion of said first connector is housed within said shell of said second connector, said first magnetic substance attracts said second magnetic substance by a magnetically attractive force to form said magnetically locking mechanism for holding said first connector to said second connector, and wherein said operating lever is depressed to pivot said cylindrical body in said counter-clockwise direction to easily disconnect said first connector from said second connector.

6. The connector unit provided with a magnetically locking mechanism as set forth in claim 5, wherein said first magnetic substance is a first permanent magnet.

7. The connector unit provided with a magnetically locking mechanism as set forth in claim 5, wherein said second magnetic substance is a second permanent magnet.

8. The connector unit provided with a magnetically locking mechanism as set forth in claim 5, wherein said first magnetic substance is a first permanent magnet and said second magnetic substance is a second permanent magnet.

9. The connector unit provided with a magnetically locking mechanism as set forth in claim 5, wherein said outer case has a locking arm for engagement with said inner case, said locking arm being released from engagement with said inner case so that said inner case can move to and from said outer case.

10. The connector unit provided with a magnetically locking mechanism as set forth in claim 6, wherein said outer case has a locking arm for engagement with said inner case, said locking arm being released from engagement with said inner case so that said inner case can move to and from said outer case.

11. The connector unit provided with a magnetically locking mechanism as set forth in claim 7, wherein said outer case has a locking arm for engagement with said inner case, said locking arm being released from engagement with said inner case so that said inner case can move to and from said outer case.

12. The connector unit provided with a magnetically locking mechanism as set forth in claim 8, wherein said outer case has a locking arm for engagement with said inner case, said locking arm being released from engagement with said inner case so that said inner case can move to and from said outer case.

* * * * *